US011454084B2

(12) United States Patent
Saeed

(10) Patent No.: US 11,454,084 B2
(45) Date of Patent: Sep. 27, 2022

(54) PRE-SET INHIBITING EXTRUSION LIMITER FOR RETRIEVABLE PACKERS

(71) Applicant: Exacta-Frac Energy Services, Inc., Conroe, TX (US)

(72) Inventor: Ahmed Mohamed Saeed, Cypress, TX (US)

(73) Assignee: EXACTA-FRAC ENERGY SERVICES, INC., Conroe, TX (US)

( * ) Notice: Subject to any disclaimer, the term of this patent is extended or adjusted under 35 U.S.C. 154(b) by 15 days.

(21) Appl. No.: 17/176,359

(22) Filed: Feb. 16, 2021

(65) Prior Publication Data

US 2021/0164317 A1 Jun. 3, 2021

Related U.S. Application Data

(63) Continuation of application No. 16/600,956, filed on Oct. 14, 2019, now Pat. No. 10,961,805.

(51) Int. Cl.
*E21B 33/12* (2006.01)
*E21B 33/128* (2006.01)

(52) U.S. Cl.
CPC ..... *E21B 33/1216* (2013.01); *E21B 33/128* (2013.01)

(58) Field of Classification Search
CPC ..... E21B 33/1216; E21B 33/128
See application file for complete search history.

(56) References Cited

U.S. PATENT DOCUMENTS 3,587,736 A 6/1971 Brown
6,598,672 B2 7/2003 Bell et al.
7,214,831 B2 5/2007 Lan-Hargest et al.
8,047,279 B2 11/2011 Barlow et al.
8,113,276 B2 2/2012 Greenlee et al.
8,567,492 B2 10/2013 White
8,955,605 B2 2/2015 VanLue
8,997,853 B2 4/2015 VanLue
9,010,411 B1 4/2015 VanLue
9,074,439 B2 6/2015 VanLue
9,157,288 B2 10/2015 Martinez
9,316,806 B2 4/2016 VanLue
9,334,703 B2 5/2016 VanLue
9,416,617 B2 8/2016 Wiese et al.
(Continued)

FOREIGN PATENT DOCUMENTS

CN 204920892 U 12/2015

OTHER PUBLICATIONS

Canadian examiner's requisition dated Mar. 26, 2021 issued against corresponding Canadian patent application No. 3,064,858—4 pages.

*Primary Examiner* — Dany E Akakpo

(74) *Attorney, Agent, or Firm* — JK Intellectual Property Law, PA

(57) ABSTRACT

A pre-set inhibiting extrusion limiter has a segmented anti-extrusion ring with a plurality of anti-extrusion ring segments supported by a stepped cone frustum. Each ring segment is retained in a run-in condition by a compression spring retained by a retainer ring held in a retainer ring groove in the respective anti-extrusion ring segments. A push ring moves the respective anti-extrusion ring segments from the run-in condition to a packer-set condition in which the anti-extrusion ring segments abut a cone frustum step of the stepped cone frustum.

19 Claims, 4 Drawing Sheets

(56) References Cited

U.S. PATENT DOCUMENTS

| | | | | |
|---|---|---|---|---|
| 9,631,453 | B2 | 4/2017 | VanLue | |
| 9,677,356 | B2 | 6/2017 | Rochen | |
| 9,719,320 | B2 | 8/2017 | VanLue | |
| 9,725,918 | B2 | 8/2017 | Young et al. | |
| 9,725,982 | B2 | 8/2017 | VanLue | |
| 9,698,228 | B2 | 9/2017 | VanLue | |
| 9,759,029 | B2 | 9/2017 | Davies et al. | |
| 9,845,656 | B2 | 12/2017 | Zimmerman et al. | |
| 10,294,749 | B2 | 5/2019 | Rochen | |
| 2002/0043368 | A1 | 4/2002 | Bell et al. | |
| 2003/0226660 | A1 | 12/2003 | Winslow et al. | |
| 2009/0255690 | A1 | 10/2009 | Conner et al. | |
| 2012/0097384 | A1 | 4/2012 | Valencia et al. | |
| 2014/0262351 | A1* | 9/2014 | Derby | E21B 33/1216 166/387 |
| 2016/0053570 | A1* | 2/2016 | Andersen | E21B 33/1208 166/179 |
| 2016/0097253 | A1 | 4/2016 | Ruffo et al. | |
| 2019/0360297 | A1 | 11/2019 | Helman et al. | |

* cited by examiner

PRE-SET INHIBITING EXTRUSION LIMITER FOR RETRIEVABLE PACKERS

RELATED APPLICATIONS

This application is a continuation of U.S. patent application Ser. No. 16/600,956 filed Oct. 14, 2019.

FIELD OF THE INVENTION

This invention relates in general to extrusion limiters for retrievable downhole pressure isolation packers used in cased well bores, such as straddle packers and, more particularly, to a pre-set inhibiting, extrusion limiter for retrievable packers.

BACKGROUND OF THE INVENTION

Retrievable packers for isolating fluid pressure in cased well bores are known in the art. One type of retrievable packer is the "straddle packer". Straddle packers are used to isolate well stimulation fluid pressure within a confined zone in a cased or open well bore. Straddle packers have a pair of spaced-apart packer elements that are respectively set to isolate the confined zone in the well bore during hydrocarbon well completion or re-completion operations. The straddle packer elements are designed to be repeatedly set and unset so the straddle packer can be moved from one location to another in the well bore. As understood by those skilled in the art, most well bores being drilled today are lateral bores. As further understood by those skilled in the art, lateral bores are often somewhat corkscrew-shaped and therefore tend to resist the insertion of lengthy well tools such as straddle packers. That resistance and/or minor obstructions in the well bore, such as casing collars in cased well bores, or the like, can urge the packer elements to pre-set before the straddle packer has been moved to a target location in the well bore. Packer element pre-set is undesirable for many reasons and may result in damage to elastomeric packer element(s).

It is also well known that the hydraulic pressures required for stimulating a hydrocarbon production zone during well completion or recompletion operations can cause elastomeric packer elements to extrude and lose their fluid seal. Packer element extrusion limiters have therefore been invented to inhibit the extrusion of elastomeric packer elements during hydraulic well stimulation. While extrusion limiters are effective in controlling packer element extrusion, they may precipitate packer element pre-set if they snag an obstruction in a cased or open well bore.

There therefore exists a need for a novel pre-set inhibiting extrusion limiter for retrievable packers.

SUMMARY OF THE INVENTION

It is therefore an object of the invention to provide a novel pre-set inhibiting extrusion limiter for retrievable packers.

The invention therefore provides a pre-set inhibiting extrusion limiter for a packer element of a retrievable packer, comprising a stepped cone frustum that supports a plurality of anti-extrusion ring segments held together by a retainer ring that is retained in a retainer ring groove in the respective anti-extrusion ring segments and retains a respective compression spring for each of the respective anti-extrusion ring segments.

The invention further provides a pre-set inhibiting extrusion limiter for a packer element of a retrievable packer comprising: a stepped cone frustum; and a segmented anti-extrusion ring that comprises a plurality of identical anti-extrusion ring segments held together by an elastomeric ring received in an elastomeric ring groove in a the respective anti-extrusion ring segments and a retainer ring received in a retainer ring groove in the respective anti-extrusion ring segments, a bottom of the respective retainer ring grooves comprising a ring segment spring socket that receives an end of a compression spring having an opposite end retained in a respective retainer ring spring socket in the retainer ring.

The invention yet further provides a pre-set inhibiting extrusion limiter for a packer element of a retrievable packer comprising: a stepped cone frustum; a segmented anti-extrusion ring that comprises a plurality of identical anti-extrusion ring segments held together by an elastomeric ring received in an elastomeric ring groove in the respective anti-extrusion ring segments and a retainer ring received in a retainer ring groove in the respective anti-extrusion ring segments, a bottom of the respective retainer ring grooves comprising a ring segment spring socket that receives en end of a compression spring having an opposite end retained in a respective retainer ring spring socket in the retainer ring; and a push ring having a push ring inclined surface that abuts a ring segment push surface of the respective anti-extrusion ring segments.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a novel pre-set inhibiting extrusion limiter for retrievable downhole packers, such as straddle packers. The pre-set inhibiting extrusion limiter is readily constructed from metal or composite material using material machining, injection molding, casting, composite tape laying or 3-D printing techniques well known in the art.

The pre-set inhibiting extrusion limiter includes a stepped cone frustum that supports a segmented anti-extrusion ring having a plurality of anti-extrusion ring segments held together by a retainer ring that supports a compression spring that urges each anti-extrusion ring segment to a non-expanded or "run-in condition" to inhibit packer element pre-set. An elastomeric ring is supported in an elastomeric ring groove in each anti-extrusion ring segment. The elastomeric ring stabilizes the anti-extrusion ring segments during the packer setting operation and helps maintain even gaps between the expanded anti-extrusion ring segments. The elastomeric ring also inhibits packer element extrusion between the expanded ring segments and provides a back-up seal to the packer sealing element when it contacts a well casing in a "packer-set condition". A push ring urges the segmented anti-extrusion ring to the packer-set condition when the packer is set. The push ring has an inclined surface to promote the expansion of the segmented anti-extrusion ring to the packer-set condition.

In one embodiment, the pre-set inhibiting extrusion limiter includes an auxiliary push ring with auxiliary compression springs that can be pre-loaded to provide a biased "cushion" between the push ring and packer set components. This is useful in small diameter open or cased well bores where a compressive force of the segmented anti-extrusion ring compression springs is necessarily limited by size constraints.

PARTS LIST

| Part No. | Part Description |
|---|---|
| 10 | Pre-set inhibiting extrusion limiter |
| 12 | Stepped cone frustum |
| 14 | Segmented anti-extrusion ring |
| 16 | Anti-extrusion ring segments |
| 18 | Elastomeric ring |
| 20 | Retainer ring |
| 22 | Push ring |
| 24 | Push ring inclined face |
| 26 | Cone frustum step |
| 27 | Ring segment step |
| 28 | Compression springs |
| 30 | Retainer ring groove |
| 32 | Lower cone surface |
| 33 | Lower Ring Segment Surface |
| 34 | Upper cone surface |
| 35 | Upper Ring Segment Surface |
| 36 | Ring segment face |
| 38 | Ring segment push surface |
| 40 | Ring segment spring socket |
| 42 | Retainer ring spring socket |
| 44 | Elastomeric ring groove |
| 50 | Packer element |
| 52 | Well casing |
| 54 | Packer mandrel |
| 56 | Packer compression sleeve |
| 58 | Packer stationary sleeve |
| 70 | Pre-set inhibiting extrusion limiter for small diameter |
| 72 | Auxiliary push ring |
| 74 | Auxiliary compression springs |
| 76 | Auxiliary push ring spring sockets |
| 78 | Push ring auxiliary spring sockets |

Figure 1:
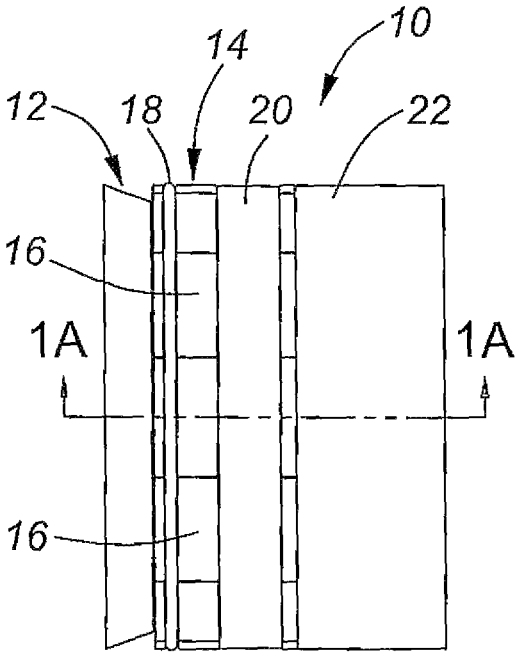
FIG. 1 is a side elevational view of an embodiment of a pre-set inhibiting extrusion limiter in accordance with the invention, in an unexpanded or "run-in" condition.

FIG. 1 is a side elevational view of an embodiment of a pre-set inhibiting extrusion limiter 10 in accordance with the invention, in an unexpanded or "run-in" condition. The pre-set inhibiting extrusion limiter 10 is constructed using metal or composite components, which include a stepped cone frustum 12 that supports a segmented anti-extrusion ring 14 having a plurality of anti-extrusion ring segments 16. The respective anti-extrusion ring segments 16 are held together and urged to the unexpanded or run-in condition by a retainer ring 20 and an elastomeric ring 18, as will be explained below in detail with respect to FIGS. 1B and 1C. A push ring 22 urges the respective anti-extrusion ring segments 16 to the expanded or set condition when the pre-set inhibiting extrusion limiter 10 is shifted to the expanded or "packer-set" condition, as will be explained below with reference to FIGS. 1B and 1C.

Figure 1B:
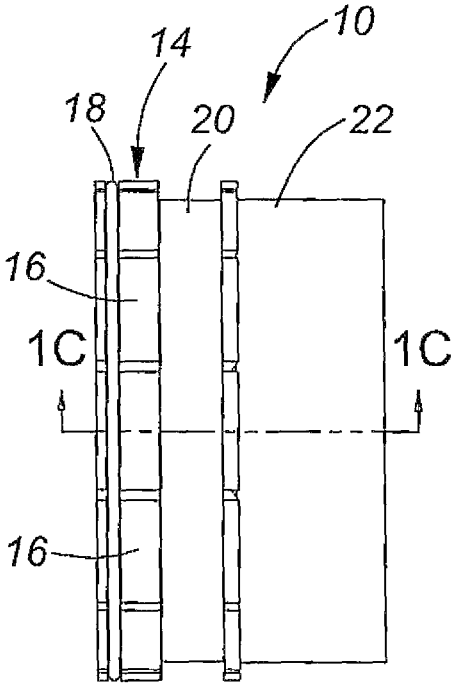
FIG. 1B is a side elevational view of the pre-set inhibiting extrusion limiter shown in FIG. 1 in an expanded, or "packer set" condition.
Figure 1A:
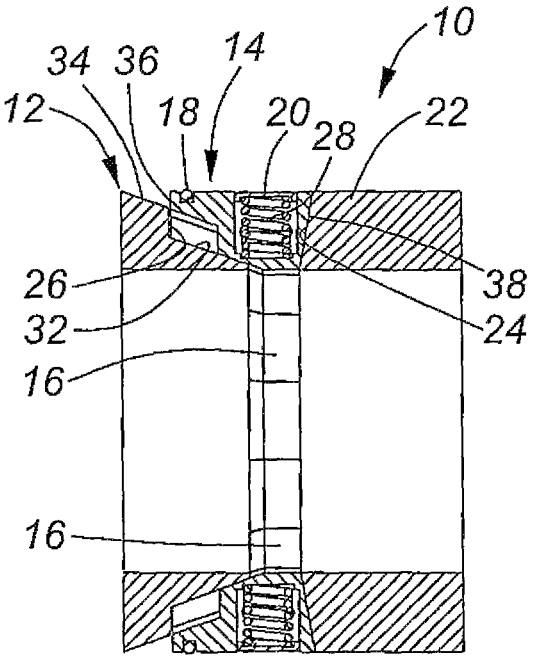
FIG. 1A is a cross-sectional view of the pre-set inhibiting extrusion limiter taken along lines 2-2 of FIG. 1.

FIG. 1A is a cross-sectional view of the pre-set inhibiting extrusion limiter 10 taken along lines 1A-1A of FIG. 1. In the run-in condition, the anti-extrusion ring segments 16 are respectively urged against a packer mandrel (not shown for clarity of illustration) and a lower cone surface 32 of the stepped, cone frustum 12 by respective compression springs 28 retained between the retainer ring 20 and the respective anti-extrusion ring segments 16. An inclined face 24 of the push ring 22 contacts a ring segment push surface 38 of the respective anti-extrusion ring segments 16.

FIG. 1B is a side elevational view of the pre-set inhibiting extrusion limiter 10 shown in FIG. 1 in an expanded, or "packer set" condition. As can be seen, in the packer-set condition the segmented anti-extrusion ring 14 is urged by the push ring 22 upwardly over the stepped cone frustum 12 against a resistance of the compression springs 28. The elastomeric ring 18 inhibits abrupt movement of the anti-extrusion ring segments 16 as the pre-set inhibiting extrusion limiter 10 is moved to/from the packer-set condition; promotes even gaps between the anti-extrusion ring segments 16 in the packer-set condition; inhibits packer elastomer extrusion through gaps between the respective anti-extrusion ring segments 16 in the packer set condition; and provides auxiliary sealing against a well casing after a packer is set in a cased well bore.

Figure 1C:
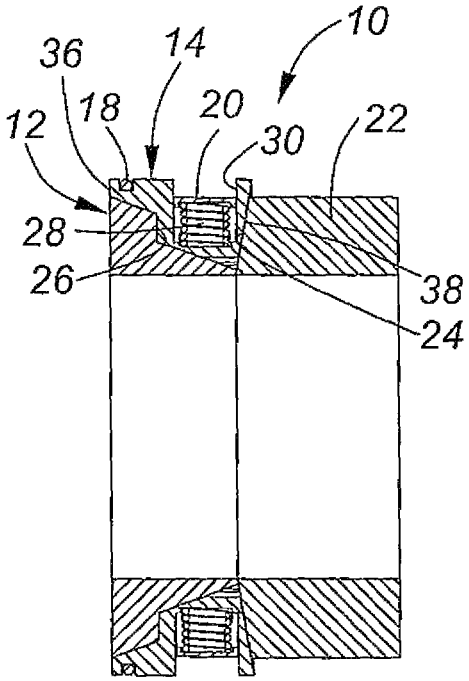
FIG. 1C is a cross-sectional view of the pre-set inhibiting extrusion limiter taken along lines 4-4 of FIG. 1B.

FIG. 1C is a cross-sectional view of the pre-set inhibiting extrusion limiter 10 taken along lines 1C-1C of FIG. 1B. As can be seen, in the packer-set condition the respective anti-extrusion ring segments 16 are forced up over the stepped cone frustum 12 by the push ring 22 until each anti-extrusion ring segment 16 contacts a cone frustum step 26 of the stepped cone frustum 12. As the segmented anti-extrusion ring 14 expands, the retainer ring 20 slides downwardly in a retainer ring groove 30 in the respective anti-extrusion ring segments 16 as the respective compression springs 28 are compressed by the upward movement of the anti-extrusion ring segments 16 on the stepped cone frustum 12.

Figure 2:
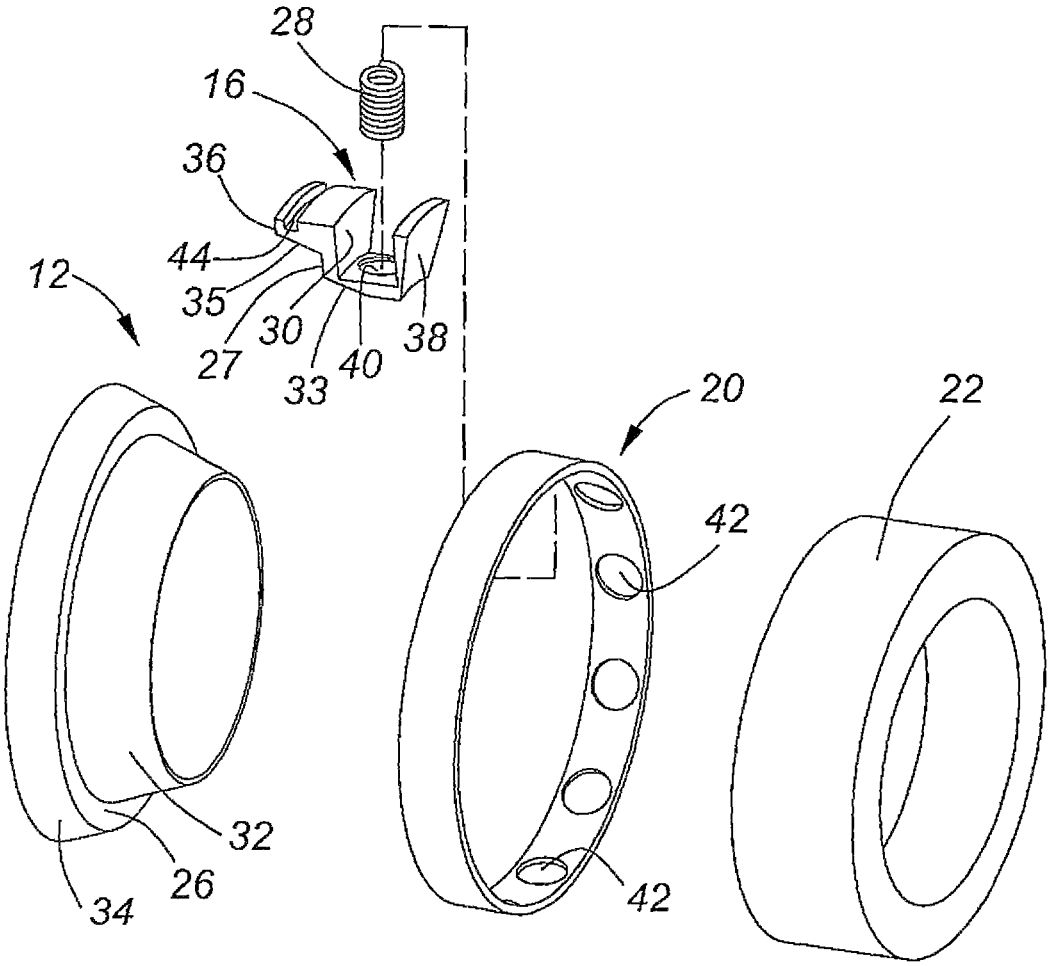
FIG. 2 is an exploded view of non-elastomeric components of the pre-set inhibiting extrusion limiter shown in FIGS. 1-4.

FIG. 2 is an exploded view of non-elastomeric components of the pre-set inhibiting extrusion limiter 10 shown in FIGS. 1-1C. The respective anti-extrusion ring segments 16 are identical and have a ring segment face 36 that faces a packer element (see FIG. 4A) and the ring segment push surface 38 contacted by the push ring inclined face 24 (see FIG. 1C). Each anti-extrusion ring segment 16 also has a ring segment step 27 that abuts the cone frustum step 26 when the segmented anti-extrusion ring 14 is in the packer-set condition; a lower ring segment surface 33 that is supported by the lower cone surface 32; an upper ring segment surface 35 that is supported by the upper cone surface 34 when the segmented anti-extrusion ring 14 is in the packer-set condition; and, a ring segment spring socket 40 that receives an inner end of the compression spring 28. The push ring 22 has a corresponding retainer ring spring socket 42 for each anti-extrusion ring segment 16. An elastomeric ring groove 44 in each anti-extrusion ring segment 16 supports the elastomeric ring 18, as described above.

Figure 3:
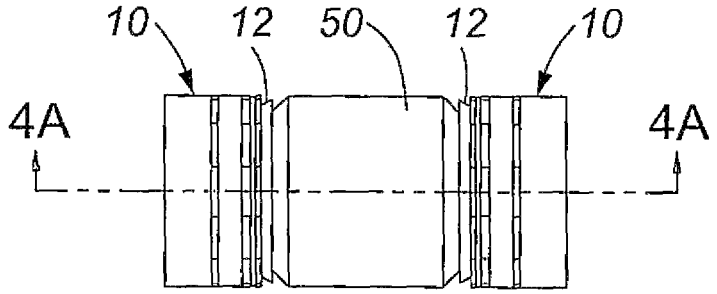
FIG. 3 is a perspective view of a packer element equipped with pre-set inhibiting extrusion limiters shown in FIG. 1, in a run-in condition.

FIG. 3 is a perspective view of a packer element 50 equipped with the pre-set inhibiting extrusion limiter 10 shown in FIG. 1, in the run-in condition. As can be seen, the pre-set inhibiting extrusion limiter 10 is always oriented on a packer mandrel 54 (see FIG. 4A) so that the stepped cone frustum 12 is adjacent the packer element 50.

Figure 4A:
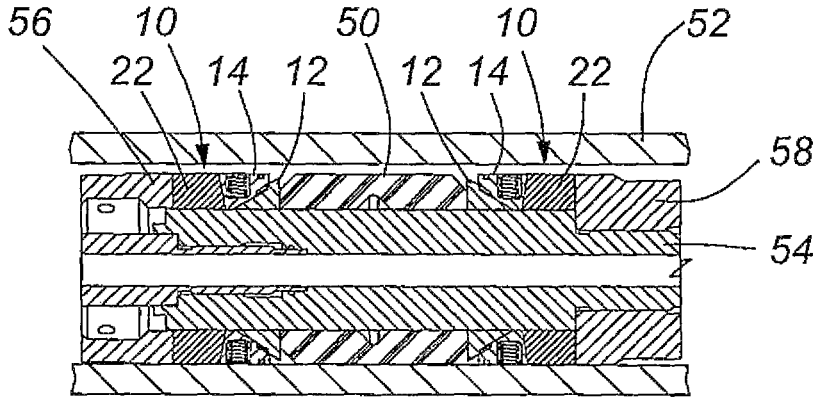
FIG. 4A is a cross-sectional view, taken along lines 7-7 of FIG. 3, of the packer element shown in FIG. 3 in a well casing.

FIG. 4A is a cross-sectional view of the packer element 50 shown in FIG. 3, taken along lines 7-7 of FIG. 3. The packer element 50 is shown on a packer mandrel 54 and that has been inserted into a well casing 52. In this embodiment, the packer element 50 is compressed to the packer-set condition by a packer compression sleeve 56 that sides over the packer mandrel 54. A packer stationary sleeve 58 provides a fixed point against which the packer element 50 is compressed. The packer element compression sleeve 56 is reciprocated from the run-in condition to the packer-set condition by a motive force controlled from the surface. The motive force may be a mechanical force transmitted through a work string (not shown) or a hydraulic force generated with one or more pistons (not shown) by fluid pumped down a work string, in a manner well understood in the art. In the run-in condition, the packer element 50 normally rests on a bottom surface of the well casing 52.

Figure 4B:
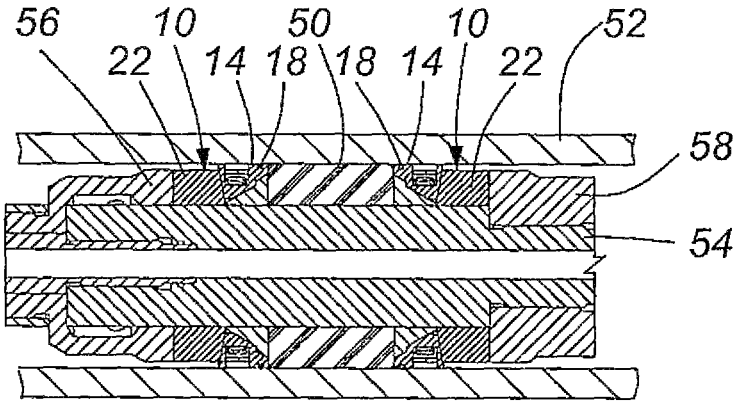
FIG. 4B is a perspective view of the packer element shown in FIG. 4A in a packer-set condition.

FIG. 4B is a perspective view of the packer element 50 shown in FIG. 4A in a packer-set condition. As can be seen, in the packer-set condition, the packer element compression sleeve 56 has been moved toward the packer stationary sleeve 58, urging the respective push rings 22 to drive the respective segmented anti-extrusion rings 14 up the respective stepped cone frustums 12 to compress the packer element 50 into sealing contact with the well casing 52. This urges the segmented anti-extrusion rings 14 into contact with the well casing 52, which centralizes the packer element 50 within the well casing to ensure equal distribution of the packer element 50 around the packer mandrel 54 and provide a superior fluid seal while minimizing any probability of extrusion under extreme fluid pressures. In addition, as described above the elastomeric ring 18 contacts the well casing 52 to provide the auxiliary seal against the well casing 52 and inhibit extrusion of the packer element 50 through the small gaps between the anti-extrusion ring segments 16 in the packer-set condition.

Figure 5:
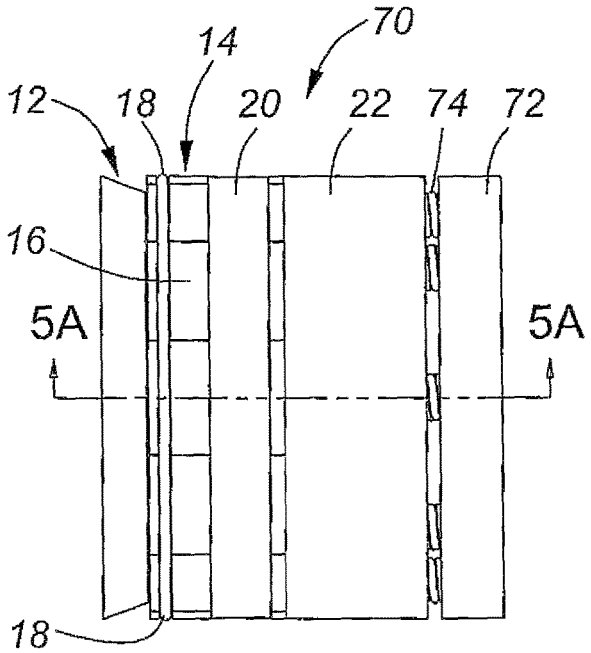
FIG. 5 is a side elevational view of another embodiment of a pre-set inhibiting extrusion limiter in accordance with the invention, in the run-in condition.

FIG. 5 is a side elevational view of another embodiment of a pre-set inhibiting extrusion limiter 70 in accordance with the invention, in the run-in condition. The pre-set inhibiting extrusion limiter 70 is particularly adapted for use with retrievable packers that are set in small diameter well bores or well casings, where size constraints limit a resilience of compression springs 28 retained by the retainer ring 20. All components of the pre-set inhibiting extrusion limiter 70 are identical to those described above with an exception of an auxiliary push ring 72 and auxiliary compression springs 74 respectively received in respective auxiliary push ring spring sockets 76 and push ring auxiliary spring sockets 78 (see FIG. 5A). The respective auxiliary compression springs 74 are installed on a packer mandrel under a pre-load compression that exerts a force on the push ring 22 which is less than an axial force required to overcome a combined compressive force of the compression springs 28 retained by the retainer ring 20.

Figure 5B:
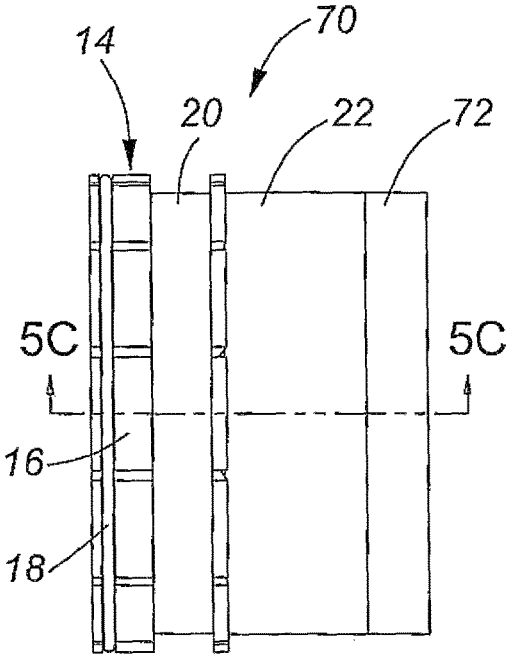
FIG. 5B is a side elevational of the pre-set inhibiting extrusion limiter shown in FIG. 5 in a packer-set condition.
Figure 5A:
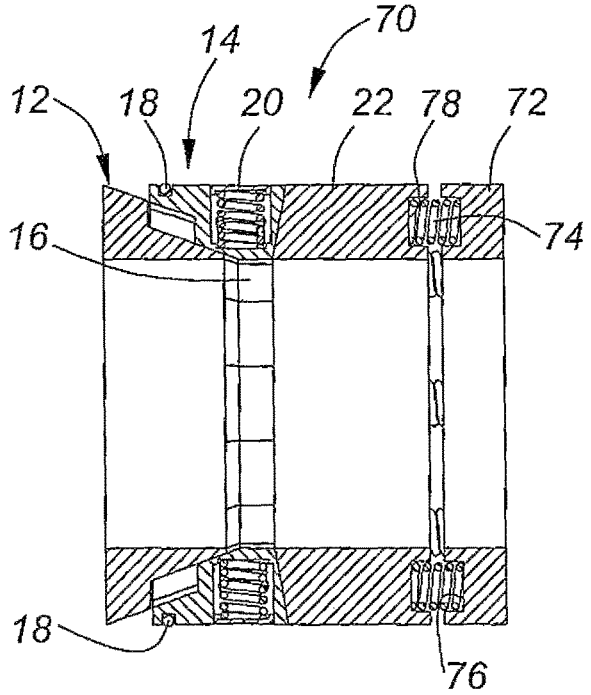
FIG. 5A is a cross-sectional view, taken along lines 5A-5A of FIG. 5, of the pre-set inhibiting extrusion limiter shown in FIG. 5.

FIG. 5A is a cross-sectional view of the pre-set inhibiting extrusion limiter 70 shown in FIG. 5, taken along lines 5A-5A of FIG. 5. As explained above, in the run-in condition the respective auxiliary compression springs 74 are under a compressive load, but do not urge the push ring 22 against the segmented anti-extrusion ring 14 with enough axial force to overcome a combined compressive resilience of the compression springs 28.

FIG. 5B is a side elevational of the pre-set inhibiting extrusion limiter 70 shown in FIG. 5 in a packer-set condition. In the packer set condition, the auxiliary push ring 72 abuts the push ring 22 and the segmented anti-extrusion ring 14 abuts the stepped cone frustum 12.

Figure 5C:
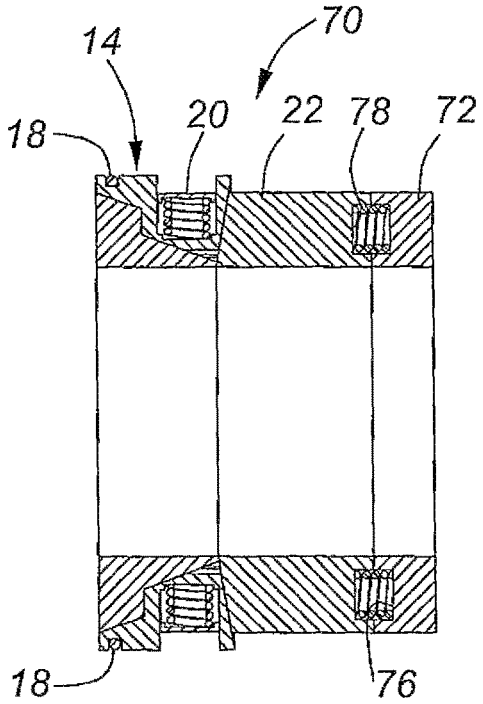
FIG. 5C is a cross-sectional view, taken along lines 5C-5C of FIG. 5B, of the pre-set inhibiting extrusion limiter shown in FIG. 5B.

FIG. 5C is a cross-sectional view of the pre-set inhibiting extrusion limiter 70 shown in FIG. 5B, taken along lines 5C-5C of FIG. 5B. When a packer element 50 of a retrievable packer provided with the pre-set inhibiting extrusion limiters 70 is released from the packer-set condition, the auxiliary compression springs 74 assist the decompressive force of a small diameter packer element 50 and the compression springs 28 to return the segmented anti-extrusion ring 14 to the run-in condition.

The explicit embodiments of the invention described above have been presented by way of example only. Other embodiments of the pre-set inhibiting extrusion limiter are readily constructed with minor alterations, as will be understood by those skilled in the art. The scope of the invention is therefore intended to be limited solely by the scope of the appended claims.

I claim:

1. A pre-set inhibiting extrusion limiter for a packer element of a retrievable packer, comprising:

a stepped cone frustum having a lower cone surface an upper cone surface and a cone frustum step between the lower cone surface and the upper cone surface;

a plurality of anti-extrusion ring segments respectively having a lower ring segment surface supported on the lower cone surface;

a retainer ring that adapted to be retained in a retainer ring groove in the respective anti-extrusion ring segments; and a compression spring adapted to be captured between each of the respective anti-extrusion ring segments and the retainer ring.

2. The pre-set inhibiting extrusion limiter as claimed in claim 1 further comprising an elastomeric ring adapted to be received in an elastomeric ring groove in a top surface of each anti-extrusion ring segment.

3. The pre-set inhibiting extrusion limiter as claimed in claim 1 further comprising a push ring having a push ring inclined face that is adapted to abut a ring segment push surface of the respective anti-extrusion ring segments.

4. The pre-set inhibiting extrusion limiter as claimed in claim 3 further comprising an auxiliary push ring and a plurality of auxiliary compression springs respectively adapted to be received in respective push ring auxiliary spring sockets in the push ring and the auxiliary push ring.

5. The pre-set inhibiting extrusion limiter as claimed in claim 4 wherein the auxiliary compression springs are under pre-load compression.

6. The pre-set inhibiting extrusion limiter as claimed in claim 1 wherein the respective ring segments comprise a ring segment face that adapted to abut the cone frustum step when the pre-set inhibiting extrusion limiter is in a run-in condition.

7. The pre-set inhibiting extrusion limiter as claimed in claim 1 wherein the respective anti-extrusion ring segments comprise a ring segment push surface, the lower ring segment surface supported by the lower cone surface, a ring segment step adapted to abut the cone frustum step when the pre-set inhibiting extrusion limiter is in a packer-set condition, and an upper ring segment surface that is supported by the upper cone surface when the anti-extrusion ring segments are in the packer-set condition.

8. The pre-set inhibiting extrusion limiter as claimed in claim 7 wherein a bottom surface of the retainer ring groove in the respective anti-extrusion ring segments comprises a ring segment spring socket.

9. A pre-set inhibiting extrusion limiter for a packer element of a retrievable packer comprising:

a segmented anti-extrusion ring that comprises a plurality of anti-extrusion ring segments urged to an unexpanded run-in condition by an elastomeric ring received in an elastomeric ring groove in a the respective anti-extrusion ring segments and a retainer ring received in a retainer ring groove in the respective anti-extrusion ring segments, a bottom of the respective retainer ring grooves comprising a ring segment spring socket that receives an end of a compression spring having an opposite end retained in a respective retainer ring spring socket in the retainer ring;

and a stepped cone frustum having a lower cone surface adapted to support the respective anti-extrusion ring segments in the run-in condition.

10. The pre-set inhibiting extrusion limiter as claimed in claim 9 wherein the stepped cone frustum comprises the lower cone surface, an upper cone surface and a cone frustum step between the lower cone surface and the upper cone surface.

11. The pre-set inhibiting extrusion limiter as claimed in claim 10 further comprising a ring segment step of the respective anti-extrusion ring segments adapted to abut the cone frustum step when the pre-set inhibiting extrusion limiter is in a packer-set condition.

12. The pre-set inhibiting extrusion limiter as claimed in claim 10 wherein the upper cone surface is adapted to support an upper ring segment surface of the respective anti-extrusion ring segments when the pre-set inhibiting extrusion limiter in a packer-set condition.

13. The pre-set inhibiting extrusion limiter as claimed in claim 9 further comprising a push ring having a push ring inclined surface adapted to abut a ring segment push surface of the respective anti-extrusion ring segments.

14. The pre-set inhibiting extrusion limiter as claimed in claim 13 further comprising an auxiliary push ring adapted to support a plurality of auxiliary compression springs respectively received in respective push ring auxiliary spring sockets in the push ring and auxiliary push ring spring sockets in the auxiliary push ring.

15. The pre-set inhibiting extrusion limiter as claimed in claim 14 wherein the auxiliary compression springs are under pre-load compression.

16. A pre-set inhibiting extrusion limiter for a packer element of a retrievable packer comprising:

a stepped cone frustum having a lower cone surface, an upper cone surface and a cone frustum step between the lower cone surface and the upper cone surface;

a segmented anti-extrusion ring that comprises a plurality of identical anti-extrusion ring segments that are urged to an unexpanded run-in condition by an elastomeric ring adapted to be received in an elastomeric ring groove in the respective anti-extrusion ring segments and a retainer ring adapted to be received in a retainer ring groove in the respective anti-extrusion ring segments, a bottom of the respective retainer ring grooves comprising a ring segment spring socket adapted to receive an end of a compression spring having an opposite end retained in a respective retainer ring spring socket in the retainer ring; and a push ring having a push ring inclined surface adapted to abut a ring, segment push surface of the respective anti-extrusion ring segments.

17. The pre-set inhibiting extrusion limiter as claimed in claim 16 further comprising an auxiliary push ring adapted to support a plurality of auxiliary compression springs under pre-load compression respectively received in respective push ring auxiliary spring sockets in the push ring.

18. The pre-set inhibiting extrusion limiter as claimed in claim 16 wherein the respective anti-extrusion ring segments comprise a ring segment face that faces the packer element.

19. The pre-set inhibiting extrusion limiter as claimed in claim 18 wherein the ring segment face is adapted to abut a top edge of the cone frustum step when the pre-set inhibiting extrusion limiter is in the unexpanded run-in condition.

* * * * *